US005803293A

United States Patent [19]

Lovekin

[11] Patent Number: 5,803,293

[45] Date of Patent: Sep. 8, 1998

[54] PET WASTE RECEPTACLE

[76] Inventor: Jennifer L. Lovekin, P.O. Box 578, Eatontown, N.J. 07724

[21] Appl. No.: 807,525

[22] Filed: Feb. 27, 1997

[51] Int. Cl.[6] ..... B65D 6/00

[52] U.S. Cl. ..... 220/4.03; 220/495.05

[58] Field of Search ..... 220/4.03, 495.01, 220/495.04, 495.05, 495.1

[56] References Cited

U.S. PATENT DOCUMENTS

| | | | |
|---|---|---|---|
| 328,240 | 10/1885 | Maylor | 220/4.03 |
| 1,111,589 | 9/1914 | Jackson | 220/4.03 |
| 2,030,344 | 2/1936 | Young | 220/4.03 |
| 2,377,548 | 6/1945 | Giordano | 220/4.03 |
| 4,083,466 | 4/1978 | McManaway | 220/4.03 |
| 4,852,757 | 8/1989 | Gold | 220/4.03 |
| 4,974,737 | 12/1990 | Miller | 220/4.03 |
| 5,642,831 | 7/1997 | Lynd | 220/4.03 |

*Primary Examiner*—Joseph M. Moy
*Attorney, Agent, or Firm*—Charles I. Brodsky

[57] ABSTRACT

A receptacle for feces, urine and other pet waste utilizes a cylindrical container for storage until final disposition of the waste is to be made. The container includes a lower section, a middle section and a top section, all removably closed off with a lid and cover, with a collecting bag being held in position at the top section and into which individually retrieved and sealed bags of waste are inserted and suspended after the waste has been scooped up or otherwise gathered. The collecting bag may then be disposed of once the accumulations reach objectionable amounts.

14 Claims, 4 Drawing Sheets

PET WASTE RECEPTACLE

FIELD OF THE INVENTION

This invention relates to the collecting of pet wastes, and more particularly, to a receptacle which permits storage of wastes until accumulations reach objectionable levels for final disposition to be made.

BACKGROUND OF THE INVENTION

As is well known and understood, many apartment dwellers and senior citizens keep such animals as cats and dogs as companions. As is also well known and understood, it is oftentimes inconvenient for the apartment dweller to walk his, or her, dog when "nature calls" or to easily dispose at unsafe hours of a tray of cat litter which begins to smell. For senior citizens, walking the dog at night could represent a danger, especially where the apartment dweller resides in a high crime area. Lifting of a heavy litter pan represents a further problem for those of advancing years. Even in those situations where the dog or cat can be trained to go in the apartment, the task still remains of disposing of the waste—either by carrying it to an outdoors dumpster, or placing it in an incinerator (where one may be available), or carrying it downstairs to a garbage pail. Obviously, keeping it in a bag in the apartment over night could represent an objectionable alternative.

OBJECTS OF THE INVENTION

It is an object of the present invention, therefore, to provide a new and improved alternative to these prior methods of disposing of pet wastes.

It is another object of the invention to provide an alternative that does not require heavy lifting, while, at the same time, keeping down household odors.

It is further object of the invention to provide such an alternative method of disposing of pet wastes which is inexpensive to manufacture and simple to utilize.

SUMMARY OF THE INVENTION

As will become clear from the following description, the present invention envisions a receptacle for feces, urine and other pet wastes by utilizing a cylindrical container for storage, until such time as final disposition of the waste need be made. In accordance with a preferred embodiment of the invention, the container includes a lower section, a middle section and top section —all removably closed-off with a lid and cover. With the receptacle of the invention, a collecting bag of given size is held in position at the top section, and into which individually retrieved and sealed bags of waste are inserted and suspended after the waste has been scooped up or otherwise gathered. The collecting bag may then be disposed of once the accumulations reach objectionable amounts. When a sufficient number of individually retrieved and sealed bags of waste have been recovered, the top and middle sections are removed and the larger bag then tied. At such time, the waste can be disposed of either by lifting the larger bag from the lower section of the receptacle, and carrying it to an appropriate trash facility. Alternatively, the bottom section of the receptacle, with the larger bag in place, can be carried to the trash bin, where it is simply overturned to dispose of the waste accumulations. Once the inside of the bottom section is cleansed with water and a mild detergent—and allowed to dry—the middle and top sections can be re-positioned, and a new collecting bag then put into position.

As will also be seen from the description that follows, the lower, middle and top sections of the receptacle are dimensioned to allow the top section to fit within the middle section and to be closed off by a cover. In similar manner, the middle and lower sections are dimensioned to allow the one to seat within the other, so that a complete enclosure is had. With the dimensions to be set forth, it will be seen that the cover overlies the top section, and is sealed to the sides of the middle section in keeping the receptacle odor free, with a minimum amount of odor escaping into the room.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 3:
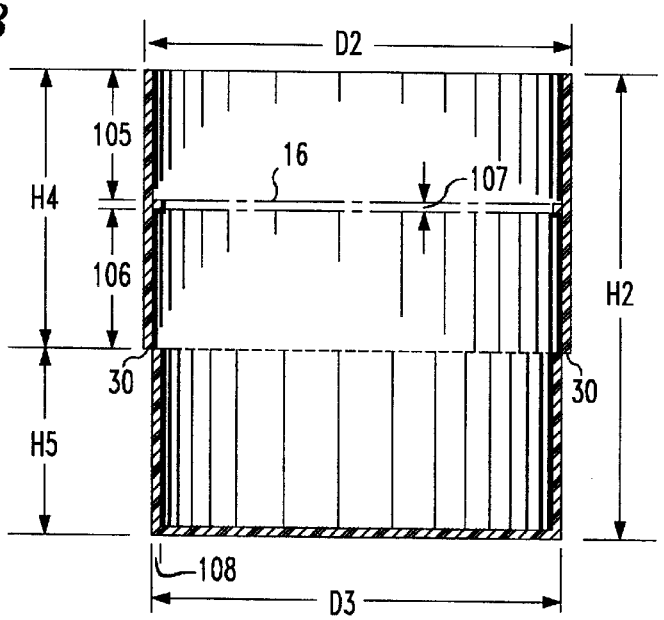
FIGS. 3 and 4 are front sectional views helpful in an understanding of the middle and lower sections of a pet waste receptacle embodying the invention, respectively.
Figure 4:
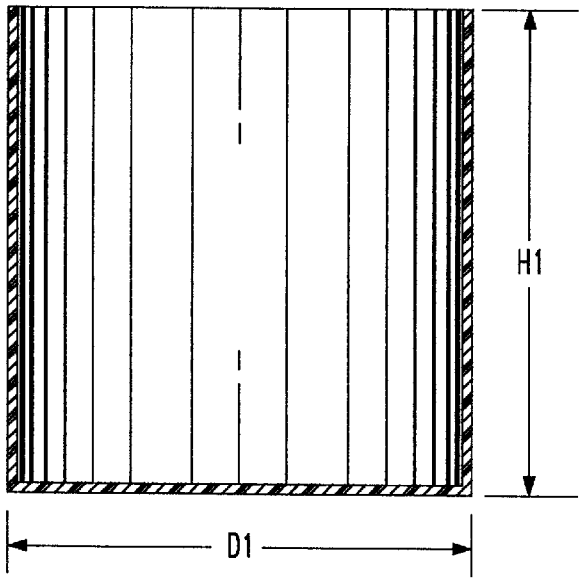

In the drawings, the lower section of the pet waste receptacle is shown at 10 of a Volume $v_1$, the middle section is shown at 12 of a volume $V_2$ and the top section is shown at 14. In a preferred embodiment of the invention, the volume $V_1$ is greater than the volume $V_2$, and in part follows from the height $H_1$ of the lower section 10 being greater than the height $H_2$ of the middle section 12. The height $H_3$ of the top section 14 is similarly selected less than the height $H_2$ of the middle section 12, and the top section 14 is dimensioned so that the top section 14 fits wholly within the middle section 12. To such end, a shelf 16 is included within the middle section 12 to support the top section 14 (FIG. 3).

Figure 1:
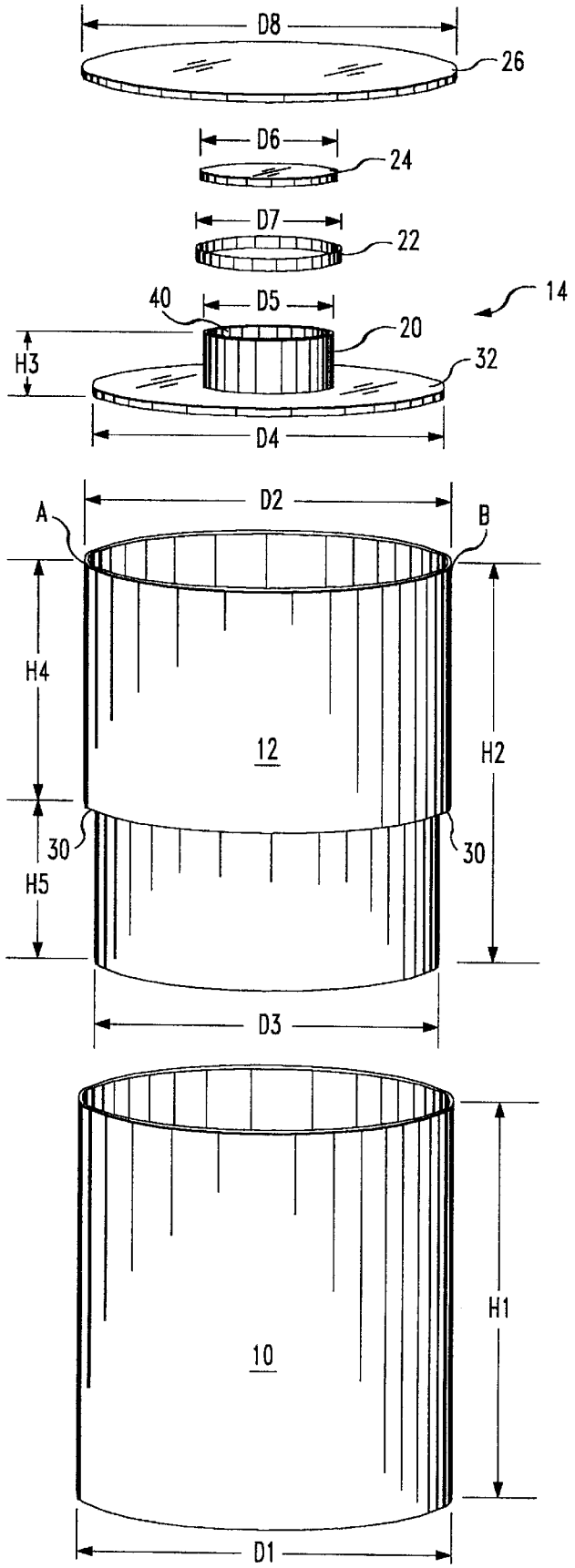
FIG. 1 is a disassembled view of a pet waste receptacle embodying the invention, helpful in an understanding of its construction.
Figure 2:
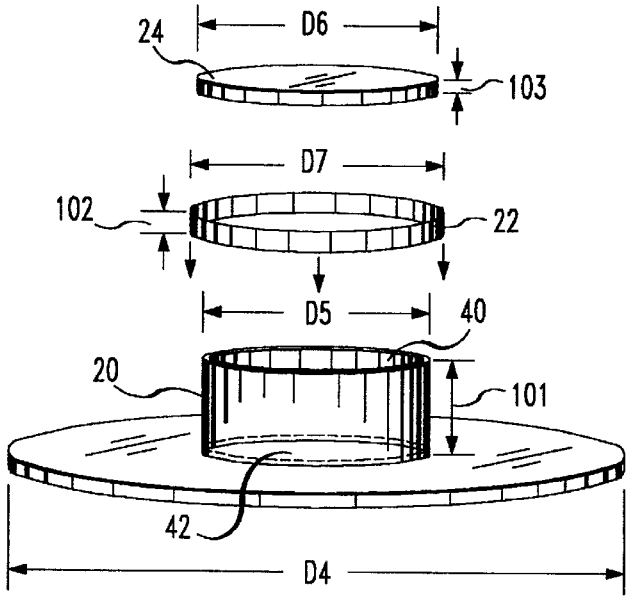
FIG. 2 is a disassembled view helpful in an understanding of the top section of the waste receptacle.

As particularly shown in FIGS. 1 and 2, the top portion 14 includes an upwardly extending chimney section 20 around which a collar 22 is arranged to fit, with a lid 24 selected of dimension to fit internally of the chimney 20 in closing it off. As will be appreciated, with the top portion 14 (along with its chimney, the collar 22 and the lid 24) inserted within the middle section 12 so as to rest atop the shelf 16, the entire portion 14 falls within the middle section 12. A cover 26 is then provided (FIGS. 1 and 8) to close off the top of the middle section 12, and to secure to its sides, as at A and B.

In a preferred embodiment of the invention, the lower section 10 essentially comprises a cylinder of diameter $D_1$. At the same time, the middle section 12 comprises a housing having a top portion of diameter $D_2$ and a lower portion of diameter $D_3$. As indicated in FIGS. 1 and 3, the diameter $D_2$ is slightly greater than the diameter $D_3$. To obtain this, the middle section 12 is indented inwardly along its height $H_2$ around the outside of the housing, as at 30. Essentially, the middle section 12 thus comprises a cylinder of two portions, of unequal diameter, and of heights $H_4$ and $H_5$. In a preferred embodiment of the invention, the diameter $D_2$ of the middle section 12 is selected substantially equal to the diameter $D_1$ of the lower section 10, and the height $H_4$ is selected greater than the height $H_5$.

In like manner, the top portion 14 is comprised of a housing having a lower portion 32 of diameter $D_4$ and a top portion of lesser diameter $D_5$, shown as the chimney 20. In this preferred embodiment of the invention, the diameter $D_4$ of the top section 14 is selected less than the diameter $D_2$ of the middle section 12 —for example, substantially equal to the diameter $D_3$ of the middle section 12. The chimney portion 20 of the top section 14 is of a different diameter $D_5$ entirely, and is closed off by the lid 24, whose diameter $D_6$ is slightly larger than the diameter $D_5$, so as to close off the chimney 20, and to grasp it on its sides, as at C and D. The collar 22 is also selected of circular cross-section, having a diameter $D_7$ greater than the diameters $D_5$ and $D_6$, and fits over the chimney portion 20. As will be appreciated, the chimney portion 20 includes an aperture as at 40, which communicates with a like aperture in the lower portion 32, as more clearly shown in FIG. 2. There, the aperture in lower portion 32 is shown by the reference notation 42. Also shown in FIG. 2 is the collar 22 which surrounds the chimney portion 20, and the lid 24 which closes off the apertures 40, 42 in a removable manner, as to be described below.

Figure 8:
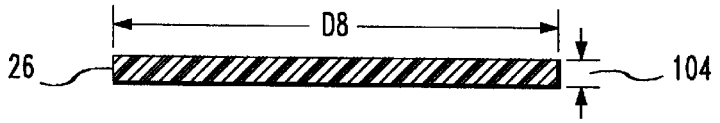
FIG. 8 is a front sectional view of a cover for the pet waste receptacle of the invention.
Figure 5:
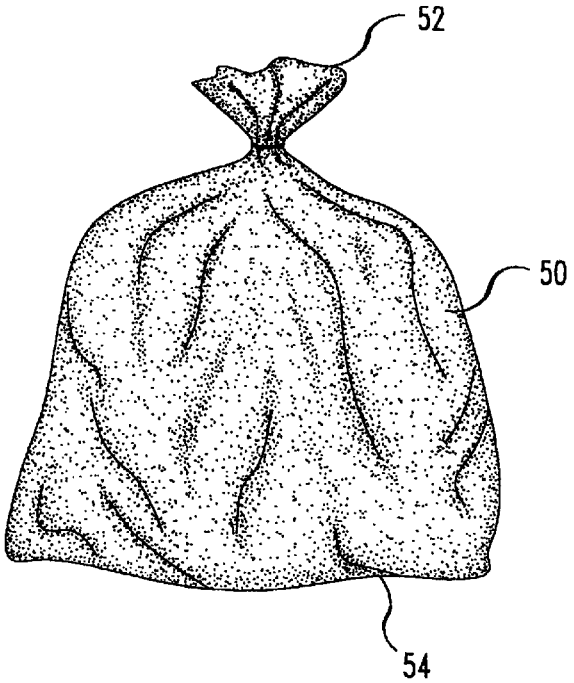
FIG. 5 illustrates a type of collecting bag to be inserted through the top section of the receptacle to extend into the middle and lower sections and to be suspended thereat.

FIG. 5 illustrates a collecting bag to be used in temporarily storing individual bags of pet waste—whether in the nature of litter, feces, urine, etc. As shown by the reference numeral 50, the collecting bag 50 has an opened upper end 52 and a closed bottom end 54. As will be understood, the opened upper end 52 fits in the space between the chimney portion 20 and the collar 22, and then folded through the collar 22 and over its edges, to be held in place thereat. The lid 24 is then placed in position, over the sides of the chimney portion 20, to further close off the apertures 40 and 42, and to hold the collecting bag 50 in position. With the top portion 14—and the collecting bag 50 held in place by the collar 22—then placed into the middle section 12 so as to sit upon the shelf 16, the cover 26 is then placed into position to close off the pet waste receptacle. Such cover is also selected of circular cross-section, having a diameter $D_8$, which is selected slightly greater than the diameter $D_2$ of the middle section 12, so as to adhere to its sides at A and B, as previously mentioned. A front sectional view of the cover 26 is shown in FIG. 8.

Figure 6:
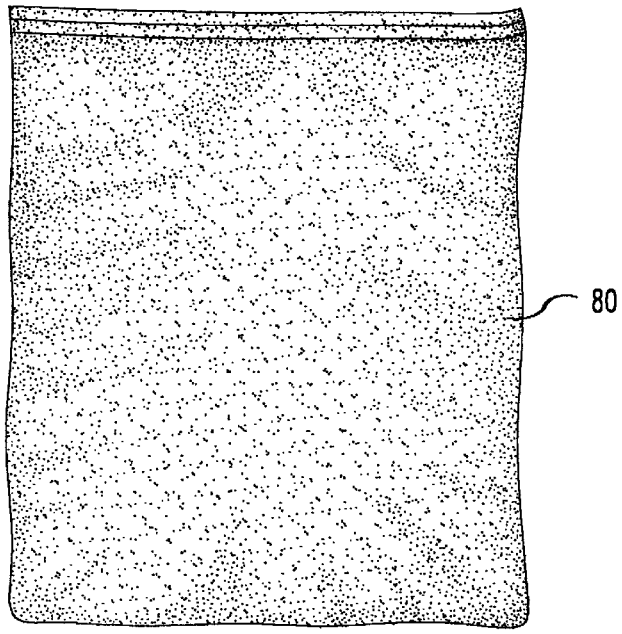
FIG. 6 illustrates a disposal bag for retrieving individual waste in the nature of feces and/or urine to be stored within the collecting bag of FIG. 5.
Figure 7:
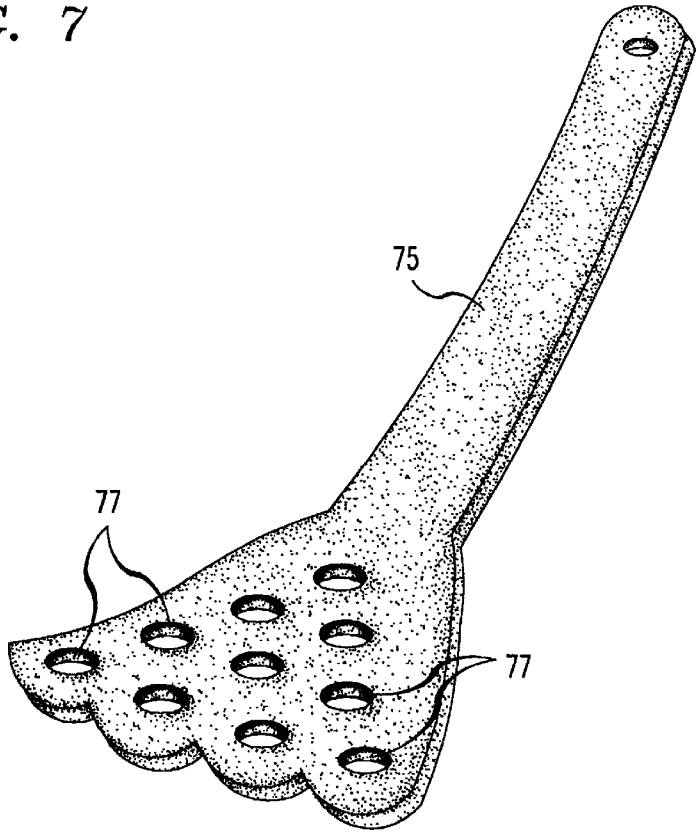
FIG. 7 illustrates a scoop which may be utilized in retrieving the waste for gathering in the disposal bags of FIG. 6.

FIG. 6 shows an individual disposal bag 80 to be filled with waste material as gathered by the scoop 75 of FIG. 6. Shown with its own apertures 77, the scoop 75 may take any appropriate shape, as long as it is operable to retrieve the waste material from a litter pan, or able to lift waste from a floor or other horizontal surface. The individual disposal bag 80 is then filled with the material gathered by the scoop 75, and then tied off in any appropriate manner, or otherwise sealed closed. At such time, the cover 26 is removed from the middle section 12, the lid 24 is likewise removed, and the filled waste bag 80 then inserted through the apertures 40, 42 into the collecting bag 50 to be held and suspended in the collecting bag which extends through the middle section 12 and into the lower section 10. The lid 24 and the cover 26 are then placed back into position, closing off the waste receptacle for further use. Because a tight closure is formed by the lid 24 with the chimney portion 20, and by the cover 26 with the upper portion of the middle section 12, odors are kept within the receptacle, and prevented from escaping into the room where the receptacle is maintained.

As will be appreciated, the process is continued anew whenever further waste is collected, deposited into its own individual disposal bag 80, and placed within the collecting bag 50 after first removing the cover 26 and the lid 24. The lid 24 and cover 26 are then replaced once again—and the process continues until such time as there has been an accumulation of individual disposable bags which reach objectionable levels.

At such time, the process is repeated once more, with the cover 26 removed, with the lid 24 removed—but this time, with the collar 22 removed as well, at which time the opened upper end 52 of the collecting bag 50 can be tied off or otherwise sealed in any desired manner. Then, the upper section 14 can be removed, and the collecting bag simply lifted from the middle section 12 and the bottom section 10, to be placed in a trash facility—or, alternatively, carrying the sections 12 and 10 to the trash bin where the sections are simply overturned to allow the filled collecting bag to drop out. When this is done, the middle section 12 can be returned to its place in the lower section 10, the top portion 14 returned to its position atop the shelf 16 in the middle section 12, and a fresh collecting bag 50 fitted through the apertures 40, 42 to fit back into the receptacle, to be held in place by the overlapping collar 22.

When the receptacle of the invention is fabricated of a plastic composition, it becomes but a simple task to clean the receptacle using soap and mild detergent. The inside of the sections 10 and 12 can be cleaned and dried in ensuring that the receptacle will be clean and ready for use properly after each time that the waste accumulation has been disposed of.

While Applicant does not wish to be limited to any particular set of dimensions, the following have proved useful in a preferred construction of the invention:

| | |
|---|---|
| Diameter $D_1$ | 12" |
| Diameter $D_2$ | 12" |
| Diameter $D_3$ | 11⅞" |
| Diameter $D_4$ | 11⅞" |
| Diameter $D_5$ | 4" |
| Diameter $D_6$ | 4⅛" |
| Diameter $D_7$ | 4⅛" |
| Diameter $D_8$ | 12⅛" |
| Height $H_1$ | 14⅛" |
| Height $H_2$ | 12" |
| Height $H_3$ | 3⅞" |
| Height $H_4$ | 8" |
| Height $H_5$ | 4" |

Also useful in a preferred construction of the invention are the following dimensions, as shown on the drawings:

| | |
|---|---|
| Dimension 101 | 2" |
| Dimension 102 | 1" |
| Dimension 103 | 1" |
| Dimension 104 | 1" |
| Dimension 105 | 4" |
| Dimension 106 | 4" |
| Dimension 107 | ¼" |
| Dimension 108 | ⅛" |

While there has been described what is considered to be a preferred embodiment of the present invention, it will be appreciated by those skilled in the art that modifications can be made without departing from the scope of the teachings herein. For at least such reason, therefore, resort should be had to the claims appended hereto for a true understanding of the scope of the invention.

I claim:

1. A pet waste receptacle comprising:

a first section of a height $H_1$ and of a volume $V_1$;

a second section of a height $H_2$ and of a volume $V_2$, having a lower portion placable into said first section and a top portion which extends upwardly from said first section;

a third section having a lower portion placeable into said top portion of said second section and a top portion which extends upwardly from said second section;

with each of said top and lower portions of said third section having an aperture to receive a collecting bag inserted through said third section to hang downwardly through said second section and into said first section;

a collecting bag of given size having an open upper end and a closed bottom end inserted through said apertures of said top and lower portions of said third section;

means on said top portion of said third section to cooperate with said collecting bag in holding said collecting bag in fixed position;

a lid closing off said apertures of said third section; and with each of said lid, said means, said third section and said second section being removably insertable with said apertures of said third section, said top portion of said third section, said top portion of said second section and said top portion of said first section respectively, to seal off and retrieve said collecting bag when it is desired to dispose of any waste material accumulated therein.

2. The pet waste receptacle of claim 1 wherein said volume $V_1$ of said first section is greater than said volume $V_2$ of said second section.

3. The pet waste receptacle of claim 2 wherein there is also included a cover extending over said top portion of said third section.

4. The pet waste receptacle of claim 2 wherein each of said first, second and third sections comprise housings of circular cross-section.

5. The pet waste receptacle of claim 4 wherein said first section includes a cylinder of diameter $D_1$, and wherein said second section includes a housing having a top portion of diameter $D_2$ and a lower portion of lesser diameter $D_3$.

6. The pet waste receptacle of claim 5 wherein said third section includes a housing having a lower portion of diameter $D_4$ and a top portion of lesser diameter $D_5$.

7. The pet waste receptacle of claim 6 wherein said diameters $D_1$ and $D_2$ are substantially equal.

8. The pet waste receptacle of claim 7 wherein said diameters $D_3$ and $D_4$ are substantially equal.

9. The pet waste receptacle of claim 8 wherein said lid closing off said apertures of said third section is of circular cross-section of diameter $D_6$, greater than said diameter of said top section $D_5$.

10. The pet waste receptacle of claim 9 wherein said means for holding said collecting bag in fixed position includes a collar of circular cross-section of diameter $D_7$ greater than said diameter of said top section $D_5$.

11. The pet waste receptacle of claim 10 wherein said means for holding said collecting bag in fixed position includes a collar of circular cross-section of diameter $D_7$ greater than said diameter of said lid $D_6$.

12. The pet waste receptacle of claim 11 wherein said third section, said collar and said lid seat within said top portion of said second section.

13. The pet waste receptacle of claim 12 wherein there is also included a cover of circular cross-section of diameter $D_8$ extending over said top portion of said third section, and wherein said diameter $D_8$ is greater than said diameter $D_2$.

14. The pet waste receptacle of claim 13 wherein there is also included a disposable bag of size less than said size of said collecting bag, inserted through said apertures of said top and lower portions of said third section and through said open upper end of said collecting bag towards said closed bottom end of said collecting bag.

* * * * *